US005186323A

United States Patent [19]

Pfleger

[11] Patent Number: 5,186,323

[45] Date of Patent: Feb. 16, 1993

[54] DUAL COMPARTMENT MIXING CONTAINER

[76] Inventor: Frederick W. Pfleger, 1152 Barbara Dr., Cherry Hill, N.J. 08003

[21] Appl. No.: 719,637

[22] Filed: Jun. 24, 1991

[51] Int. Cl.[5] ..... B65D 25/08

[52] U.S. Cl. ..... 206/221; 215/DIG. 8; 222/83; 366/130

[58] Field of Search ..... 206/221, 222; 215/DIG. 8, 6; 366/130; 222/80, 81, 83

[56] References Cited

U.S. PATENT DOCUMENTS

| | | | |
|---|---|---|---|
| 2,362,025 | 11/1944 | Price | 222/81 |
| 2,726,656 | 12/1955 | Lockhart | 604/212 X |
| 3,404,811 | 10/1968 | Cernei | 206/222 X |
| 3,410,444 | 11/1968 | Morane | 206/221 X |
| 3,482,258 | 12/1969 | Steen | 222/80 X |
| 3,802,604 | 4/1974 | Morane et al. | 206/222 X |
| 4,067,440 | 1/1978 | Lataix | 206/222 |
| 4,244,467 | 1/1981 | Cavazza | 206/222 |
| 4,591,049 | 5/1986 | Walter | 206/222 |
| 4,693,366 | 9/1987 | Goncalves | 206/222 |
| 4,823,946 | 4/1989 | Stoeffler et al. | 206/221 |
| 4,936,446 | 6/1990 | Lataix | 206/221 |

FOREIGN PATENT DOCUMENTS

| | | | |
|---|---|---|---|
| 2294937 | 7/1976 | France | 206/222 |

*Primary Examiner*—Bryon P. Gehman

[57] ABSTRACT

A device capable of joining, holding, and opening a pair of sealed containers with contents. Each container is attachable to one of a pair of container opening parts movable with respect to each other. While in the attaching position the containers are maintained in sealed condition and are held in this position with respect to each other. The containers can remain in this position indefinitely or the containers can be moved to a different position from the attaching position. During this movement between the two positions, each of the pair of container opening parts opens a container and forms a passageway almost equal to the area of the seals for the contents of the containers to flow into either container to mix the contents of both containers.

16 Claims, 2 Drawing Sheets

DUAL COMPARTMENT MIXING CONTAINER

BACKGROUND OF THE INVENTION

This invention relates to an improved method of combining or intermixing the contents of two (2) containers which can be flexible wall containers, rigid wall containers, or semirigid wall containers. The containers can contain sterile contents or nonsterile contents. The contents can be liquid and/or powders. The containers can be joined to the attaching elements of the invention at one time and at a later time the device can be activated and the contents can be mixed without effecting the sterility or the cleanliness of the contents. The attaching elements of the invention are capable of being attached to the rigid, semirigid or flexible wall container that has clamping or threaded attaching means. The elements are capable of functioning with the containers sealed with resilient stoppers or with bonded membrane members or any combination of seals. The elements of this invention allow the passageway for intermixing the contents to be almost as large as the exit or inlet port of the containers. They also allow the flow of the contents to go in either or both directions, that is, into either container. The elements also can lock the containers to the elements so that they or the device must be destroyed in order to separate the containers.

Prior patents which show a method for mixing two materials include Nos. 4,614,267, to Larkin; 4,703,864 to Larkin; 4,614,515 to Tripp; 4,610,684 to Knox; 3,532,254 to Bork; 3,290,017 to Davies; and 2,176,923 to Nitardy. These devices are deficient in that they do not enable the intermixing to occur between rigid, semirigid or flexible containers. U.S. Pat. No. 4,614,267, although providing for sterile mixing, must utilize a flexible bag for one of the containers. The flexible bag is necessary since the operation of removing the seal plugs must be done from the outside of the flexible bag which is very cumbersome and time consuming.

It is therefore a principle object of this invention to provide an improved means to intermix two sterile materials without breaking sterility.

It is another object of this invention to provide a means to intermix two materials simply by moving the containers from the first assembled position to the second activating position.

It is another object of this invention to provide a means to intermix two materials when needed while enabling the two containers to be joined awaiting mixing for any length of time for storage.

It is another object of this invention to provide a means to intermix materials regardless of whether the materials are packaged in containers with rigid walls, semirigid walls or flexible walls.

It is another object of this invention to provide a means for intermixing materials from two containers and preventing the containers from being separated without destruction to prevent reuse of the components.

It is another object of this invention to provide for intermixing material from two containers with a minimum of obstruction to the flow of the materials.

It is another object of this invention to provide for intermixing material from two containers which utilize as few parts as possible and which is low in cost to produce.

These and other objects of this present invention will become apparent from the following drawings and description.

SUMMARY OF INVENTION

This invention provides for the advantages cited above by utilizing two elements, a first element that can be attached to a rigid, semirigid, or flexible container while that container still holds its contents in a sealed, clean, or even sterile condition. The second element of the invention can be assembled to a second rigid, semirigid, or flexible container while it still holds its contents in a sealed, clean, or sterile condition. When it is desired to mix the contents of the two containers, movement of the first element with respect to the second element removes the seals from both containers and provides a large passageway for the flow of the contents from one container to the other. It allows this flow to occur while still maintaining cleanliness and sterility for the contents.

DESCRIPTION OF PREFERRED EMBODIMENT

Figure 1:
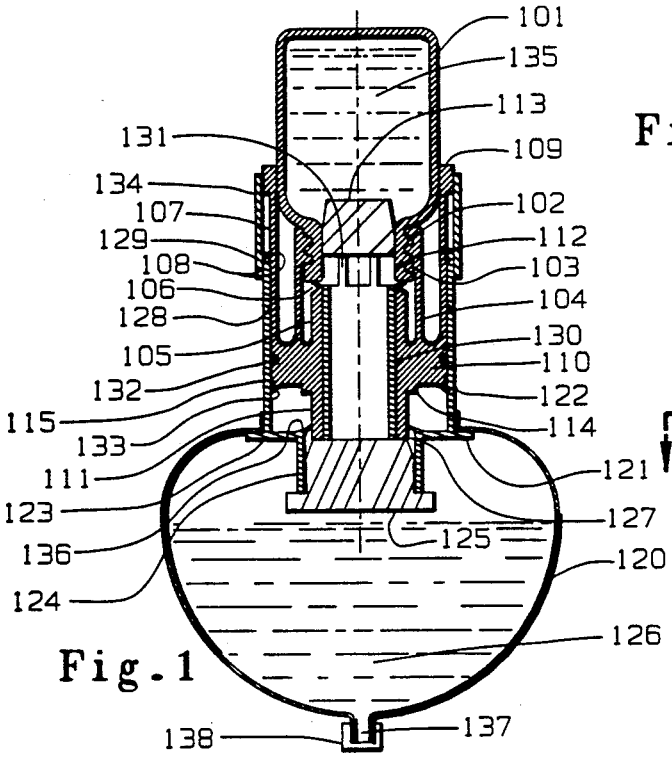
FIG. 1 is a cross section showing the combination of a rigid container with a threaded top attached to the transfer member of the invention and a flexible container attached to the ingress member of the invention with an adhesive or shrink fit attachment.

Referring to FIG. 1, a rigid container 101 is provided at its open end with threads 102 as is common in normal bottle production. Thread 102 is attached to a mating thread 103 molded as part of a hollow tube member 104 which is part of transfer member 110. Inside tube member 104 is a second tube member 105. At the external end of tube member 105 is a flexible seal member 106 which can be a flexible member formed as part of tube member 105 or it could be a resilient member such as a rubber "O" ring or rubber cap fastened to the external end of tube member 105. As a result, when the container 101 is threaded together to transfer member 110, the top of the container 101 engages the seal and produces a sealed fit when the container is screwed tight. A third tube called the external tube 107 also is part of transfer member 110. External tube 107 is provided with an external tapered ring 108 see FIG. 8, and an upstanding container guide flange 109. Guide flange 109 is provided to give added support to container 101. Before the container 101 is threaded into transfer member 110 a diaphragm seal or a cap, not shown, can cover the open end of the guide flange 109 to seal the transfer member 110 from particles if the guide member is used in clean applications or the seal can provide a means to retain sterility for sterile applications.

Figure 8:
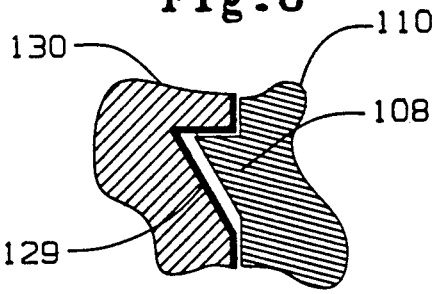
FIG. 8 is a partial sectional view showing the detenting of the transfer member of the invention engaging a detent groove of the ingress member of the Invention.

As shown in FIG. 8, tooth 108 is designed with a shape that allows transfer member 110 to move only in one direction.

A second container 120 is fabricated from flexible material and bonded or heat sealed to a flange 121 of an ingress member 115. Ingress member 115 comprises a tube 122 upstanding from a base 123. Attaching flange 121 can be secured to tube 122 anywhere along its length but in FIG. 1 it is shown in alignment with base 123. Base 123 is provided with a second tube member 124. A resilient material stopper 125 is inserted into tube 124 resulting in sealing contents 126 in container 120. Base 123 is provided with opening 127 through which arms 111 pass. Arms 111 after passing through opening 127 engage the resilient material stopper 125. Tube 122 surrounds external tube 107 and is in sliding engagement with it. On the internal surface of tube 122 are two grooves 128 and 129. Groove 129, FIG. 8, engages the tapered ring 108 and retains the transfer member 110 in a nonactive condition with ingress member 115. Internal of opening 127 is an extending tube member 130 which is concentric with tube 122. Extending tube member 130 is sized to fit inside the opening 112 of container 101. A second resilient material plug 113 is used to seal the opening 112 of container 101. The outer end of tube member 130 is provided with fingers 131 which engage the resilient material plug 113, just touching the resilient material plug 113 when the transfer member ring 108 is engaged with groove 129. A resilient member 132, a pump type gland 133 and/or an adhesive seal ring or heat seal ring 134 can provide a seal between transfer member 110 and ingress member 115 during storage before the unit is activated.

Figure 9:
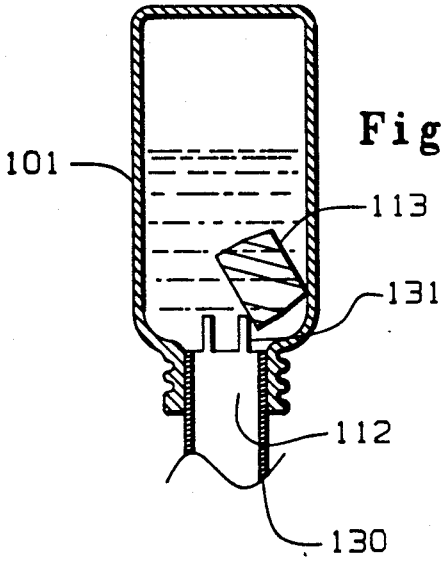
FIG. 9 is a partial cross section after the stopper in one container is removed.

In order to enable the contents 135 of container 101 to mix with the contents 126 of container 120 the seal ring 134 if it is made of rigid material must be removed. After removal, pressure applied on container 101 in the direction towards container 120 will move the transfer member 110 inwardly into ingress member 115. Tapered ring 108 will disengage from groove 129 and engage into groove 128. After engaging the groove 128, the transfer member cannot move back again into groove 129 due to the shape of the groove and tooth. This locking condition prevents the reuse of the components. The walls of tube 107 will deflect inwardly slightly and the wall of tube 122 will deflect outwardly to allow the tapered ring 108 to move to groove 128 position. In moving from groove position 129 to groove position 128, the fingers 131 of upstanding tube member 130 push the resilient material plug 113 inwardly into container 101. As shown in FIG. 9 fingers 131 prevent the resilient material plug from reentering the opening 112 of container 101 while allowing the contents to flow into tube member 130 and then into container 120. Arms 111 of transfer member 110 push the resilient stopper 125 into container 120. With both resilient material members removed, a large clear passage is available for the contents 126 and 135 to flow in either direction into either container.

When the tapered ring 108 is engaged in groove 128, the parts are positioned so that a second flexible seal 136 of ingress member 115 is deflected by a pad 114 on transfer member 110. As a result, the passageway between both containers is sealed to prevent any leaking.

In this particular combination, container 120 is provided with an exit port 137 with a cap 138 through which the mixed contents can be removed.

Figure 2:
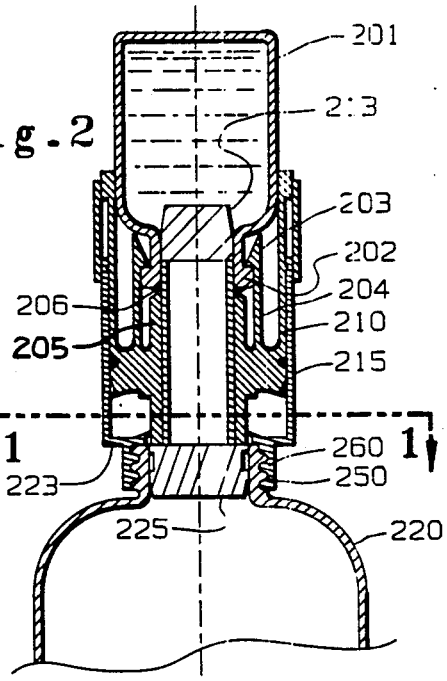
FIG. 2 is a cross section showing the combination of a rigid container with a flanged top attached to the transfer member of the invention and a rigid container attached to the ingress member of the invention with a thread attachment.

As shown in FIG. 2, container 220 is made of a rigid material such as glass or a semirigid material such as a plastic molded bottle. The inlet port into the container is provided with a threaded portion 250. The ingress member 215 is provided with a mating threaded tube 260 depending from base 223. As a result, ingress member 215 can be secured and sealed to container 220 by screwing the container 220 into the ingress member 215. Container 201 is not provided with the threaded port 102 as shown in FIG. 1 but is provided with a flanged top 202. Flange top 202 can be sealed with a ring seal over a stopper or a ring seal over a line seal as is well known in the art of sealing vials. After removing the ring seal and the line seal or stopper, the container 202 is still sealed by the resilient neck stopper 213 in the same manner as the stopper 113 of FIG. 1. In order to secure container 201 to the transfer member 210, the top of tube 204 is provided with a hook end 203 which latches over the flange top 202. The distance between the hook end 203 and the seal member 206 is less than the thickness of the flange top 202 thus compressing the seal member 206. As a result, the container 201 is sealed to transfer member 210. If the deflection force to deflect the hook member 203 over the flange 202 is too great, the hook member 203 can be slit lengthwise in the tube 204 thus producing a plurality of hook members 203 with lower deflecting force than that of a single ring hook member. After container 220 is secured to the ingress member, the unit functions in the same manner as the unit with the parts shown in FIG. 1.

Figure 3:
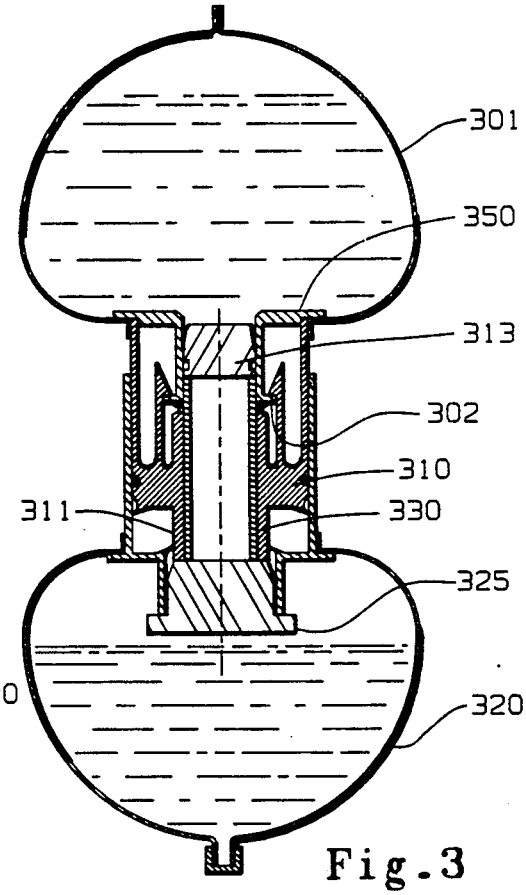
FIG. 3 is a cross section showing the combination of a flexible material container sealed with an adhesive seal or heat shrink seal attached to the transfer member of the invention and a flexible container attached to the ingress member of the invention with an adhesive or shrink seal attachment.

As shown in FIG. 3 container 301 is made from a flexible material such as a plastic bag 301. Plastic bag 301 is secured by an adhesive or by heat binding or other methods known in the art to an attaching member 350. Attaching member 350 can be provided with flange member 302 similar to bottle flange 202 of FIG. 2. It could also be made with threads similar to threads 102 of FIG. 1. As a result as shown in FIG. 3, a flexible member containing contents can be connected to another flexible member with contents so that activation of the transfer member 310 will act in the same manner as previously described in relation to FIG. 1, namely, tube 330 will remove stopper 313 from container 301 and arms 311 will remove stopper 325 from container 320 so that the contents in either container can be transferred to the other for intermixing.

Figure 4:
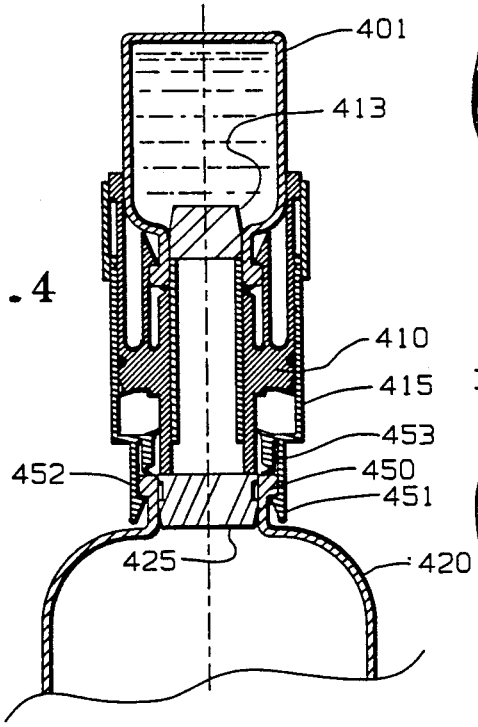
FIG. 4 is a cross section showing the combination of a flanged rigid container attached to the transfer member of the invention and a flanged rigid container attached to the ingress member of the Invention.
Figure 7:
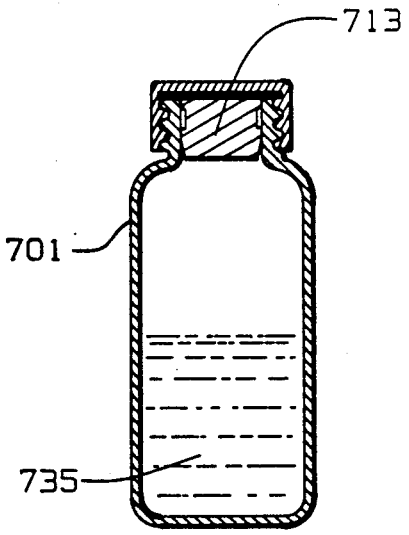
FIG. 7 is a cross section showing a vial with a resilient plug stopper and a cap over the stopper.

In reference to FIG. 4, container 420 can be made of a rigid or a semirigid material. The top of container 420 is made with a flange 450. Stopper 425 is used as the sealing member for container 420. The container 420 and the ingress member 415 are joined together by means of hook member 451 projecting inwardly from tube 452. An inner tube 453 is constructed similar to the tube 205 of FIG. 2 to provide the seal between the ingress member 410 and flange 450; as a result the seal functions in the same manner as inner tube 205 with seal 206 sealing against flange 202. Stoppers 425 and 413 are removed on movement of the transfer member as previously described. As a result, contents of container 401 and contents of container 420 can be transferred and mixed.

Figure 10:
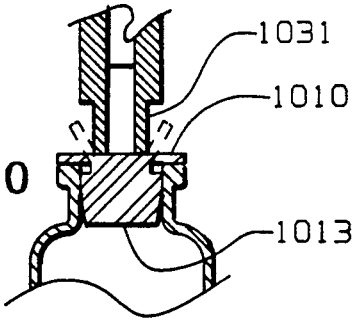
FIG. 10 is a view of a flange type of seal for the containers.

In certain applications, it may be desirable to provide a stopper for the containers which has a top sealing surface as well as a cylindrical seal. As shown in FIG. 10, the stopper comprises a top flange 1010 which is relatively thin in thickness. The thickness is thick enough to provide a seal and thin enough to be deflected as shown by the dotted line configuration. The fingers 1031, which are the same as fingers 131 of FIG. 1, can still push the stopper into the container. The fingers 1031 are displayed inwardly from the position of fingers 131 of FIG. 1 in order to allow for the thickness of the stopper flange 1010 to pass freely between the fingers 1031 and the inside of the container opening. As a result, the stopper 1013 can function in the same manner as the stopper 113 of FIG. 1.

Figure 6:
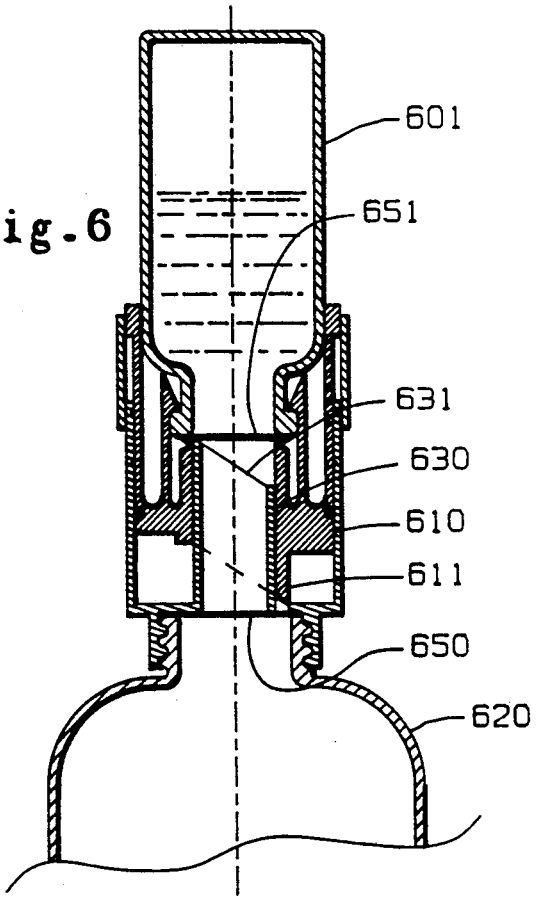
FIG. 6 is a cross section showing the combination of a flanged container attached to a transfer member of the invention sealed with a diaphragm seal and a threaded container attached to an ingress member sealed with a diaphragm.
Figure 5:
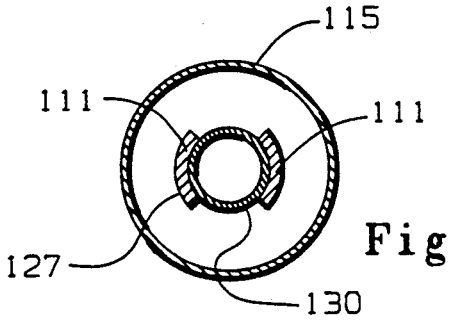
FIG. 5 is a cross section substantially along lines 1—1 of FIG. 2 showing the transfer member fingers passing through the ingress member.

In many applications of intermixing contents sterility is not required but cleanliness and interlocking of containers is desirable. As shown in FIG. 6, the containers 601 and 620 are sealed with a paper or similar type of diaphragm seal 650 and 651. Diaphragm seals 650 and 651 are secured to the container in one of the many known methods such as adhesive, heat sealing, shrink wrapping or mechanical gripping. In place of removing stopper or plugs as previously described for other combinations, diaphragm seals 650 and 651 are cut open or torn. Extending tube member 630 is provided with a cutting edge 631 which is capable of cutting out a flap or the entire diaphragm 651 as required for the application. Transfer member 610 is provided with a tube element 611 which is adjacent to tube member 630 and surrounds it a distance required to make the desired cut opening in diaphragm 650. The cut in diaphragm 650 will form a flap which drops into the neck of container 620. As a result, containers 601 and 620 are opened to permit the contents of container 601 and 620 to mix.

Although various combinations of container types have been shown, it is obvious that anyone skilled in the art can make other combinations. For example, combinations could include flexible containers each or both having threaded attaching means.

From the foregoing, it is seen that the present invention provides a combination of elements that allow each element to be connected to a sealed container such that movement of one container towards the other container under control of the elements allows the elements to open the seal of the other container and provide a connected path for the flow of either direction of the contents of the containers. The flow path is substantially the same as the size of the ports of the containers. The combinations shown are extremely simple in construction, low in cost and accomplish the desired objectives without departing from the spirit of the invention.

What is claimed is:

1. A combination of attachable containers comprising: a first container having a first port and containing a first contents, a first removable barrier at said first port sealing said first contents in said first container, a transfer member attached to said first container, a second container having a second port and containing a second contents, a second removable barrier at said second port sealing said second contents in said second container, a tube member disposed within said transfer member and integral with an ingress member said ingress member circumscribing the transfer member and attached to said second container a first position and a second position of said transfer member with respect to said ingress member, movement of said transfer member from said first position to said second position causes the transfer member to remove said second removable barrier from said second port and said tube member to remove said first removable barrier allowing the contents of said first container to mix with the contents of said second container by passing thru said tube member.

2. A combination of containers as in claim 1 including a first extending member on said tube member extending toward said first removable barrier, a second extending member on said transfer member extending toward said second removable barrier; said first extending member removing said first removable barrier and said second extending member removing said second removable barrier when said transfer member is moved from said first position to said second position.

3. A combination of containers as in claim 1 wherein said first container includes a holding flange and said transfer member includes a snapping flange attaching said first container to said transfer member.

4. A combination of containers as in claim 1 wherein said second container includes a threaded portion and said ingress member includes a mating threaded portion on said ingress member attaching said second container to said ingress member.

5. A combination of containers as in claim 1 including an extending member on said ingress member surrounding said transfer member, notches on said extending member and a mating tooth on said transfer member engageable with said notches to retain said transfer member in said first position or said second position.

6. A combination of containers as in claim 5 wherein said notches and said mating tooth have a configuration which allows the ingress member to move only in one axial direction with respect to said transfer member.

7. A combination of containers as in claim 1 including a first upstanding member on said ingress member, a second upstanding member on said transfer member mating with said first upstanding member, and detenting means on said first and said second upstanding members to retain said transfer member in either said first position or said second position.

8. A combination of containers as in claim 1 including an outlet port on at least one of said containers.

9. A combination of containers as in claim 1 wherein said first container is a rigid, a semirigid or a flexible container.

10. A combination of containers as in claim 1 wherein said second container is a rigid, a semirigid or a flexible container.

11. A combination of containers as in claim 1 including a leak seal between said transfer member and said first container and a leak seal between said ingress member and said second container.

12. A combination of two containers, a removable closure element for the first container, a removable closure element for the second container, and a container opener for removing the removable closure element from each of said two containers almost simultaneously, each of said removable elements displaceable inward into its container, the combination further comprising; securing means on each container to secure each container to said container opener, a first extending member of said container opener between the securing means of the first container and the removable closure element of the second container, a second extending member of said container opener between the securing means of the second container and the removable closure element of the first container, a first position of said first extending member relative to said second extending member, means to hold the first extending member to the second extending member in said first position, a second position of said first extending member and said second extending member resulting from movement of said first container toward said second container whereby said first extending member removes said removable closure element of said second container and said second extending member removes said removable element from said first container during movement between said first position and said second position.

13. A combination of two containers and a container opener according to claim 12 including an exit port in one of said containers.

14. A combination of two containers and a container opener according to claim 12 including leak seals between said containers and said container opener.

15. A combination of two containers and a container opener according to claim 12 wherein said securing means includes a thread on at least one of said containers and a mating thread on said container opener.

16. A combination of two containers and a container opener according to claim 12 wherein said securing means includes a flange on at least one of said containers and snapping fingers for engaging said flange on said container opener.

* * * * *